United States Patent [19]

King

[11] 4,071,019

[45] Jan. 31, 1978

[54] GREASE EXTRACTOR

[75] Inventor: Roy R. King, Houston, Tex.

[73] Assignee: Industrial Industries, Inc., Houston, Tex.

[21] Appl. No.: 675,203

[22] Filed: Apr. 8, 1976

[51] Int. Cl.[2] ..... F24C 15/20

[52] U.S. Cl. ..... 126/299 E; 55/DIG. 36

[58] Field of Search ..... 98/115 K; 126/299 A, 126/299 B, 299 E; 55/DIG. 36

[56] References Cited

U.S. PATENT DOCUMENTS

| | | | |
|---|---|---|---|
| 3,055,285 | 9/1962 | Gaylord | 98/115 K |
| 3,381,679 | 5/1968 | Gonzalez | 126/299 R |
| 3,786,739 | 1/1974 | Wright | 98/115 K |
| 3,802,329 | 4/1974 | Wright | 98/115 K |
| 3,841,062 | 10/1974 | Molitor et al. | 98/115 K X |
| 3,848,521 | 11/1974 | King | 98/115 K |
| 3,893,831 | 7/1975 | Doanne | 98/115 K X |

*Primary Examiner*—Ronald C. Capossela
*Attorney, Agent, or Firm*—Clarence A. O'Brien; Harvey B. Jacobson

[57] ABSTRACT

A grease extractor apparatus having a housing, a hood, a first chamber connecting with air and grease vapors entrained by said hood, a cold water spray nozzle system and a hot water wash system associated with said chamber, a sump at the bottom of said chamber for collecting solidified grease vapors, a second chamber connecting with said first chamber and having additional wash nozzles incorporated therewith, a third chamber for having turbulent flow therein and connected with said second chamber, a duct leading from the third chamber to an expansion chamber, the expansion chamber having an airflow baffle and third wash nozzles incorporated therewith, and an exhaust duct from the expansion chamber connected to a suction fan and a fire damper means therein.

13 Claims, 7 Drawing Figures

62

38
64
68
66
68
18
70
76
23
78
25
5
5
21
A
36
50
44
43
46"
40
27
42
34
48
46
4
4
28
46'
31
14
30
108
C
110
24
B
32
3
3
76
74
26
56
88
87
54

GREASE EXTRACTOR

BACKGROUND OF THE INVENTION

1. Field of the Invention

This invention relates generally to apparatus and systems for ventilating grease laden air having moisture, smoke, fumes, grease vapors and the like supported therein from environments such as cooking and kitchen areas.

2. Description of the Prior Art

The present invention constitutes an improvement over the ventilating systems taught and disclosed in U.S. Pat. Nos. 3,786,739 and 3,848,521, both invented by John David Wright and assigned to the assignee of the present invention. In these Wright patents, ventilating systems are suspended from a ceiling or attached to a wall, or supported from a floor structure, for the purpose of ventilating cooking areas in kitchens and particularly in restaurants and institutional food establishments. The purpose of both these patents is to remove grease type materials entrained in the exhaust air above the cooking apparatus present in such establishments. This grease laden air presents both a sanitary and fire problem and should and must be removed from the air in order to effectively inprove the sanitation and eliminate the fire problem. Both of these Wright patents are hereby incorporated by reference. The improvement of the present invention likewise is directed to removal of grease type particles from above cooking ranges and the like.

A common problem with known ventilating systems, including the ones above is that the washing and cleaning action from the spray nozzles fails to completely remove and entrain the particles contained within the air passing through the system as is desired.

Another problem with known prior art devices is that an accumulation of grease and other solidified particles coats the walls and baffle plates of the apparatus and after a sufficient amount of such particles have collected this in itself becomes a health and fire hazard.

Another problem with known devices is that the sump associated with the collection chambers fails to discharge the collected grease and other solidified particles in a positive and sure manner.

Another problem with known devices having water nozzles for wetting down and cleaning the air and baffle surfaces is that the nozzles themselves collect grease deposits and other solid deposits and become contaminated.

A further problem with known devices are that the interior baffles are fixed and unadjustable so that the balance of airflow through the unit, and especially in the case of multiple units stacked side by side, is fixed and non-adjustable. This results in the airflow depositing grease particles and solids in certain portions of the apparatus and not in others. This overall effect is undesirable.

Another problem with known devices is that the baffle system incorporated therewith are relatively complex and involve rather complex construction and repair procedures.

Known prior art patents which may be pertinent to this invention are as follows:

U.S. Pat. No. 3,207,058 — A. K. Gaylord — Sept. 21, 1965

U.S Pat. No. 3,247,776 — A. K. Gaylord — Apr. 26, 1966

U.S. Pat. No. 3,323,439 — B. D. Weaver et al. — June 6, 1967

U.S. Pat. No. 3,324,629 — E. Graswich et al. — June 13, 1967

U.S. Pat. No. 3,490,206 — DeWitt H. Doane — Jan. 20, 1970

U.S. Pat. No. 3,854,388 — Donald E. King — Dec. 17, 1974

U.S. Pat. No. 3,893,831 — DeWitt H. Doane — July 8, 1975

None of these known prior art devices offers the new and unique features of the invention disclosed herein.

SUMMARY OF THE INVENTION

An object of the present invention is to provide a grease extraction ventilating system in which exhaust air is water cooled to extract and remove grease, smoke, fumes, moisture and the like from the air in enclosed areas such as kitchens before the air is ducted to an exhaust outlet.

Another object of the present invention is to provide an improved ventilating system wherein cyclonic motion is imparted to the air being exhausted, the moving air is contacted with a cooled water spray, and entrained particles supported in the air removed by the cooling effect and collected in appropriate collection chambers within the apparatus.

A further object of this invention is to provide a grease extractor apparatus having self-cleaning and washing structure associated therewith in order to periodically remove any build up of grease and smoke residue from the internal surfaces and baffles of the apparatus.

A further object of the present invention is to provide a grease extractor and ventilating system incorporating fire blocking means together with water spray means to prevent spread and damage in case of any fire starting within the overall apparatus.

Yet a still further object of this invention is to provide a wetted plate extraction method employing a spray pattern of water being applied at an oblique angle to effect a continuous wiping action on a primary baffle plate. This prevents any substantial amount of grease and other solid particles from accumulating on the primary baffle plate, and greatly increases the overall efficiency of the grease extractor apparatus.

Another still further object of this invention is to provide a syphon effect-type grease collection sump which will cause grease floating on the surface of said sump to be moved and pushed to the sump overflow part for removal from the entire apparatus.

A still further object of the invention is to provide a grease extractor ventilating system having water nozzles which are protected from normal grease deposits from the contaminated air passing through the system in order to prevent the nozzles themselves from becoming a health and fire hazard.

A still further additional object of this invention is to provide a variety of internal baffle plates which are adjustable or changeable in order to balance air flow between adjacent units of the ventilating system.

Another still further object of this invention is to provide an integrated interior baffle design having substantially all of the baffles supported from a central support structure. In the disclosed invention, this central support structure is the basic water manifold system. This structure in effect allows the baffle design to be substantially independent of the housing or exterior body structure.

The present invention provides a ventilating system for air containing moisture, smoke, fumes, grease vapors and the like. The system water cools hot exhaust air to a point at which the grease particles condense and are extracted. The said exhaust air is collected by a conventional type hood structure and moves in a centrifugal path into an angled opening of a first chamber where it is contacted by a water spray. This water spray is directed against a primary baffle plate which also in effect performs a self-cleaning operation. At the bottom of the first chamber is a collection sump for floatably supporting the grease and other solid-like particles deposited thereon. The exhausting air continues through other chambers within the overall apparatus having additional spray wash operations associated therewith for further cleaning and removing of the contaminants from the exhaust air. Finally the air is exhausted through an exhaust duct by a conventional type suction fan structure. Prior to this final exhaust step, a fire damper plate is provided which will effectively close in case of overall fire and extreme heat within the entire apparatus. A hot wash solution structure is also provided within the apparatus for cleaning the baffle plates in a manner disclosed herein, as well as in the previous patents upon which this is an improvement. The combined water manifold for both the cold wash water and the hot wash solution also supports the primary baffle plate as well as additional baffle plates in order to form a single replaceable unit which is removable and separate from the rest of the overall housing apparatus. The interior baffles are also adjustable as well as outside plates being removable for easy access to the interior of the overall housing.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
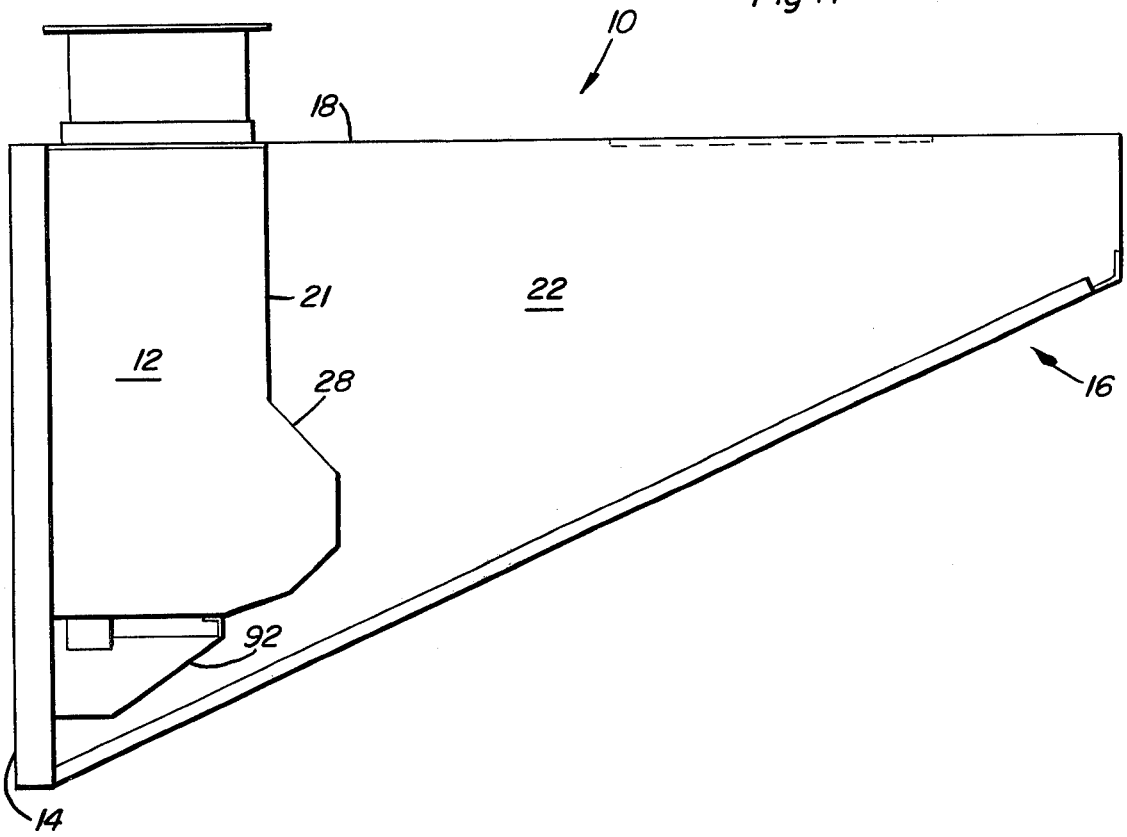
FIG. 1 is a side elevational view of the primary grease extractor apparatus of this invention as in combination with a collector hood arrangement.

Referring to FIG. 1 of the drawings, reference numeral 10 indicates the grease extractor apparatus of this invention as combined with one type of hood arrangement. The grease extractor apparatus has side panels 12, a back 14, removable front panel 21, an opening 28 to permit the polluted exhaust gases entry into the grease extractor apparatus 10, and a cover panel 92 for enclosing the sump drain pipe and plug. The hood structure referred to generally by reference numeral 16 has a top portion 18 and side panel portions 22.

The hood and housing structure for the grease extractor apparatus are generally constructed of suitable sheet metal in a conventional fashion. Normally, the hood structure 16 will be mounted over the kitchen ranges and other comtamination producing equipment. Grease and smoke laden air will therefore be collected within the hood.

Looking at FIG. 2 of the drawings, the grease extractor apparatus will now be described in greater detail. The contaminated grease and smoke laden air will enter chamber 24 through the opening 28. The primary baffle plate 30 together with a secondary baffle 31 will deflect the air laden contaminated flow downwardly as indicated by flow arrows shown. As provided in the previous U.S. Pat. No. 3,848,521, a series of cold water wash nozzles 40 are provided along a header 42. This header 42 is appropriately connected to a cold water input feed line 44. The spray of cold water out the nozzles 40 will impinge upon the primary baffle plate 30 and tend to not only keep this primary baffle plate clean but also come in contact with the contaminated exhaust air flowing through the first chamber 24. This arrangement of cold water scrubbing together with baffle plate structure more effectively removes the grease and other contaminants from the input air than in the previous patented device. The lower portion of the chamber is enclosed by appropriate sheet metal walls 26 and form a contaminant sump portion 54. Water will normally be present in the sump upon the surface of which the grease and other contaminant particles will float.

Figure 2:
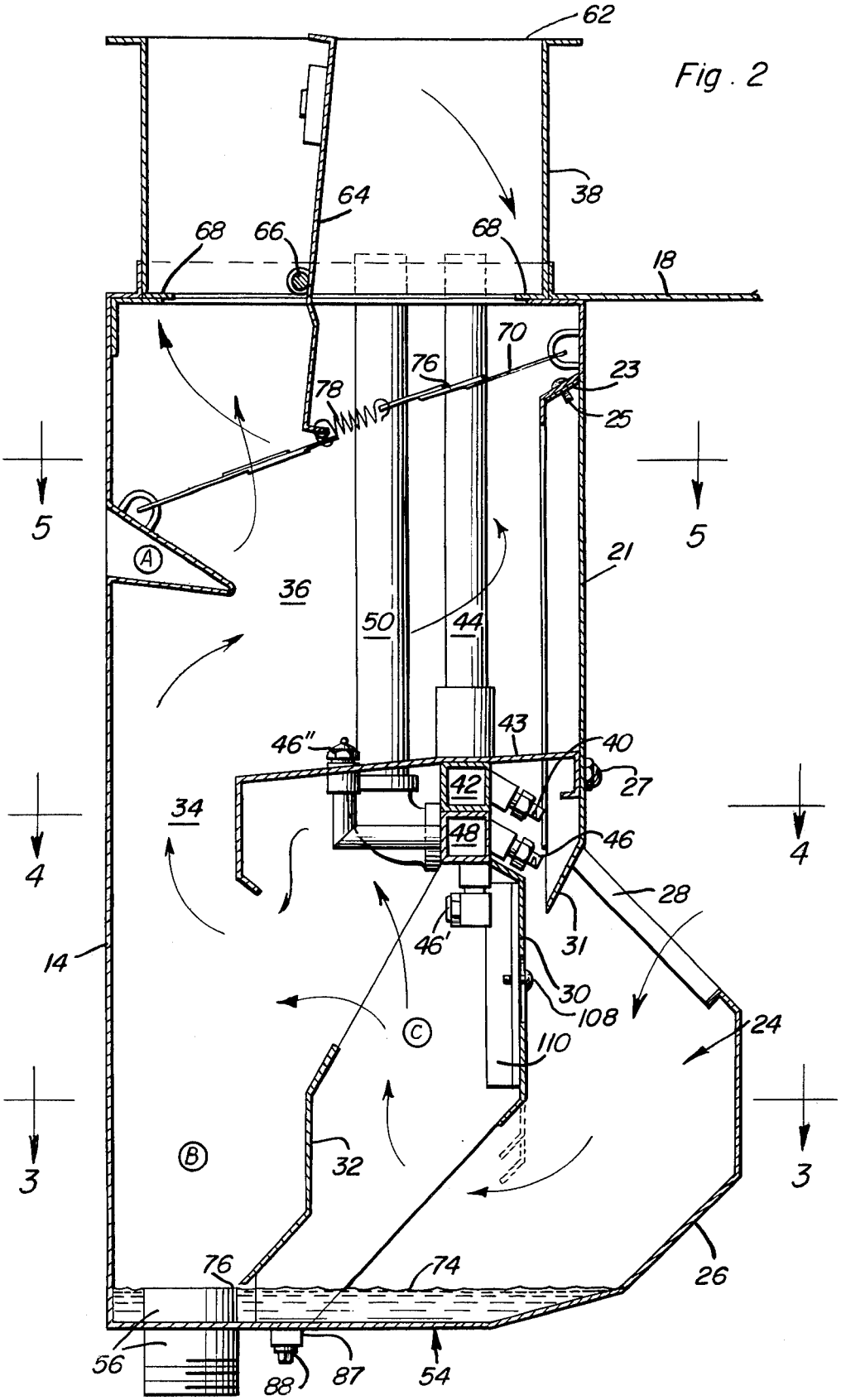
FIG. 2 is a side elevational view, partly in cross section, of the grease extractor apparatus of this invention.
Figure 3:
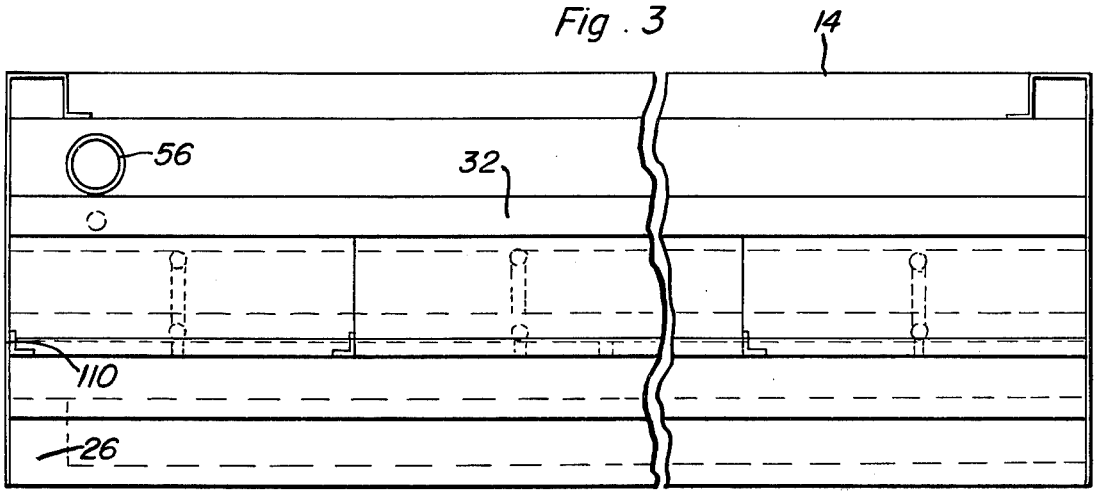
FIG. 3 is a view taken generally along line 3—3 of FIG. 2.

As can best be seen in FIG. 2, the exhaust air will pass by the upper surface of the water 74 and will tend to push or blow any grease, etc. floating on top of the surface water toward the overflow pipe 56 at the rear of the apparatus. A baffle 32, which is permanently mounted between the side walls 12 of the extractor apparatus 12, is shown slightly above the level of the overflow pipe 56. Thsi permits any accumulation of grease 76 to be pushed by the air flow into the overflow 56.

Continuing to follow the small airflow arrows, the exhaust will continue into chamber C and then curve around and downwardly into turbulent chamber B. Because of the shift in airflow direction and the cyclonic or turbulent flow created thereby more contaminant particles will be deposited at the bottom of chamber B. Again, these particles will float on the surface of the water contained in the sump and pass out through the overflow 56.

Air then continues up the duct channel 34 into an expansion chamber 36. This expansion chamber 36 has a diverter baffle A provided therein directly above the duct entrance 34 to create additional change in air flow path direction and to allow a substantial decrease in pressure within the chamber 36. From the chamber 36, air is exhausted out the exhaust duct 38 by means of an exhaust fan, not shown, of conventional construction which is connected to the outlet 62 of the exhaust duct.

Figure 4:
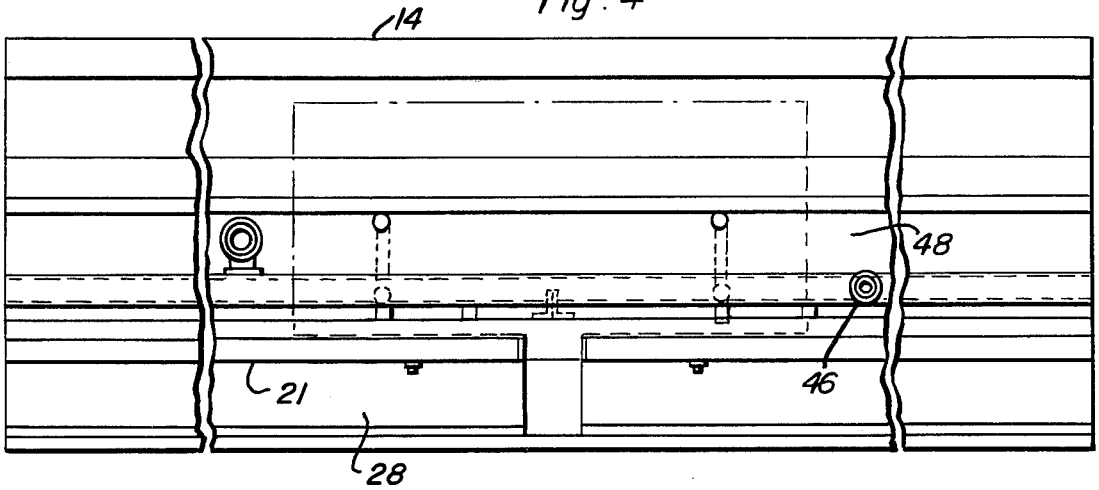
FIG. 4 is a view taken generally along line 4—4 of FIG. 2.
Figure 5:
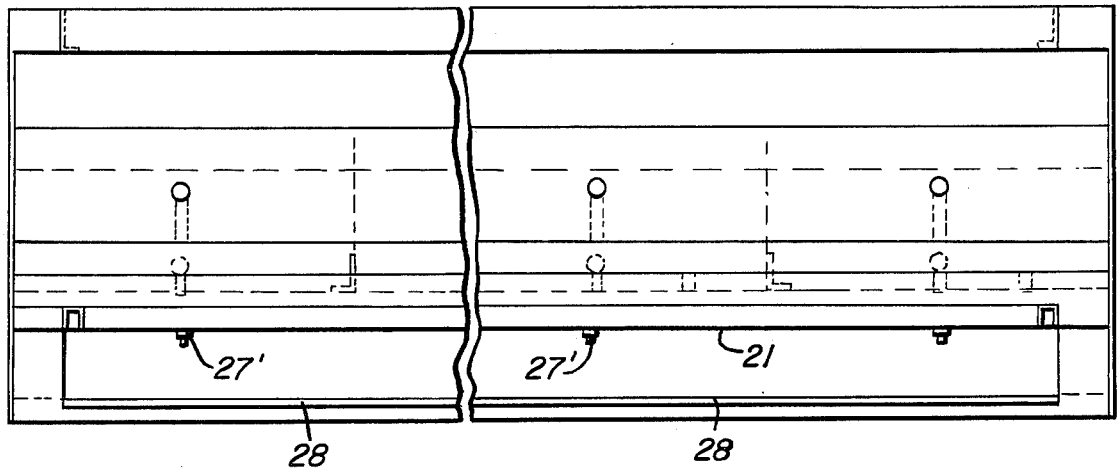
FIG. 5 is a view taken generally along line 5—5 of FIG. 2.

In addition to the cold water wash nozzles 40 and manifold 42, there are provided hot water cleaning and wash nozzles 46, 46', and 46'' appropriately connected to a hot water manifold 48. Again this structure is similar to the structure described in the previous patents. Also, the valve and input piping and control therefor for both the manifolds 42 and 48 may be similar to that shown in FIG. 4 of U.S. Pat. No 3,786,739, and appropriately described therein and incorporated herein by reference. The important function is that the cold water wash and the hot water wash and cleansing structures will be appropriately turned on as desired by the plumbing and valving. The input to manifold 48 is shown and indicated as the plumbing piping 50.

A number of important features are shown in this improved grease extractor apparatus. One of these improvements is in the front panel 21 which is readily removable from the front of the grease extractor apparatus. The panel 21 has an acutely reversed flange 23 provided on the upper edge thereof which has appropriate apertures at each end thereof, and if desired spaced therealong, for reception of pins 25 in order to positively retain the upper edge of the panel in alignment with the overall housing. The lower portion of the panel 21 fits over studded bolts 27' provided in the manifold support 43 for reception of the acorn-shaped nuts 27. The lower edge of panel 21 has the deflector baffle 31 as an integral part thereof. Thus, it can be readily visualized how by removing the acorn nuts 27, the lower portion of the entire panel 21 may be swung outwardly and the upper edge then removed from the pins 25 to entirely remove said panel from the overall apparatus. Once panel 21 is removed, then the manifold structure 42, 48 is readily reachable, as well as the nozzle structures 40, 46, 46' and 46'' for service and/or replacement.

Another important feature of this invention is in the fact that the manifold structure just described, i.e. 42, 48 and appropriate nozzle structure connected thereto also supports the primary manifold panel 43, and the primary baffle plate 30. This permits easy initial construction, and later removal and change of the entire manifold, nozzle system, and baffle arrangement in one simple operation. This is a great improvement over the previous structures known and described.

Another feature is in the primary baffle plate 30 which is removable and changable to ones of different sizes. The purpose of this being to change the amount of airflow permitted between the first chamber 24 and the second chamber C. As shown in cross section in FIG. 2, the smallest panel 30 is in use. That is the panel permitting the greatest amount of airflow. The dotted lines indicate the two other normally used baffles which will decrease or change the amount of airflow. The panel 30 may be appropriately connected to the flange supporting structure associated with the walls of the extractor apparatus in any conventional known fashion such as tap screws or the like.

In order to add additional cleaning features to the overall apparatus, a drain extension 87 with removable plug 88 is also provided at the lower portion of the sump 54.

Figure 7:
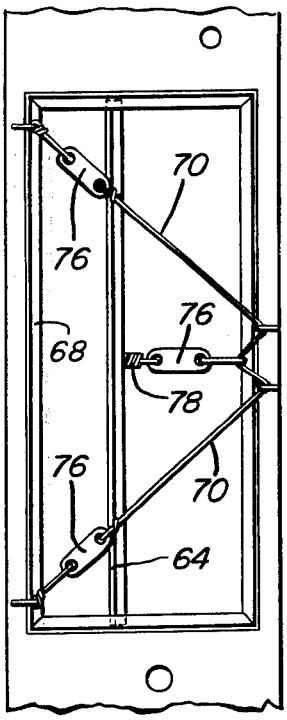
FIG. 7 is a top plan view of the fire damper apparatus provided in the exhaust duct of this invention.

Mounted at the upper outer opening of the expansion chamber 36 is the fire damper structure, best seen in FIGS. 2 and 7. This damper comprises a pivotal plate 64 mounted about the pivot 66 and appropriately anchored by airplane cable 70, fusible links 76, and a spring 78. As can be visualized, if any one of the fusible links 76 are fused by a hot fire within the grease extractor apparatus, the lower end of the damper plate 64 will be released and because of the weighted arm movement of the damper about the pivot point 66, the damper will swing into a closed position against the flanges 68 appropriately provided along the input to the duct 38. This will effectively seal the output of expansion chamber 36 and the exhaust suction provided to the opening 62. This is a very important fire and safety feature of the overall apparatus.

It should be noted that the intake port 28 is slanted approximately 45 degrees from the vertical in order to allow for immediate entrainment of the natural air current from the hood into the entry chamber 24. This design tends to overcome the natural tendency of smoke to curl back at the front edge of the hood and escape into the kitchen. Lower exhaust suctions are possible because of this feature.

It has been discovered that the combination of features of the slanted opening 28 together with baffles 30 and 32, the cold water scrubbing from nozzles 40 in conjunction with the upper expansion chamber 36 rather than a lower expansion chamber, and the additional baffle A with the additional turbulence area B behind the baffle 32 achieves a marked and greatly increased grease extraction efficiency over previous known devices. With these changes, the unit is also quite usable as an up-draft back shelf unit, or a wall hung unit, or a ceiling suspended unit.

The baffle 32 is especially shaped to allow grease particles collecting on the liquid surface 74 to be skimmed off by airflow, and collected in the rear or behind baffle 32, out of the airflow, for immediate drainage out of the overflow 56.

Baffle 30 is removable by loosening the screws 108 in brace elements 110 for access to the lower rear chamber B and also the rear hot water nozzles 46' and 46''. This baffle 30 is also provided in three different vertical heights in order to allow velocity control when different air volumes are dictated for various types of cooking equipment. The baffle normally used is one with a mid-setting (3 inches) for a single unit, regardless of air per foot. However, if more than one unit is used side by side in combination, and each has a different air volume per foot, then the appropriate baffle is used as follows:

A baffle providing a 2½ inch opening for 250 cfm per foot, 3 inches for 250 cfm per foot, or 3½ inches for 350 cfm per foot, in order to balance the overall combined unit system to one static pressure value.

Access panel 21 is in a vertical position and is completely removable. The input baffle 31 also is provided as part of the removable panel 21 and forms a protective cover for the nozzles 40 and 46. This feature provides for complete access to the upper expansion chamber 36, the fire damper fusible links 76, and the upper nozzle clusters 40, 46 and 46''.

The drain plug 88 is also provided to provide additional facilities for periodic cleaning of the sump 54. A removable enclosure 92 is normally provided for access to the drainage lines for installation and service. This panel does improve the overall appearance of the apparatus substantially.

The above improvements make the overall apparatus much more efficient in grease extraction, lowers the amount of exhaust volume required and greatly simplifies service. Manufacturing costs are also substantially lower because of the simplified construction.

As described in the previous patents, the cold water wash nozzles 40 provide a wash spray across the path of the contaminated exhaust air. The hot water wash and cleaning nozzles 46, 46' and 46'' are used to impart hot cleaning water and washing solution to the interior of the overall apparatus in order to effectively scrub down and wash away any deposited contaminants from the interior of the overall housing. Obviously, all of the above described liquids will be removed out the lower sump drain 56.

As can be readily visualized, as the contaminated exhaust air enters the input port 28 and continues past the various washing and baffle stages up to the expansion chamber 36, a very efficient extraction of grease particles, smoke, fumes and the like will take place. The deposited contaminants will be washed backwardly to the overflow outlet 56 and appropriately discarded out conventional waste channels.

Figure 6:
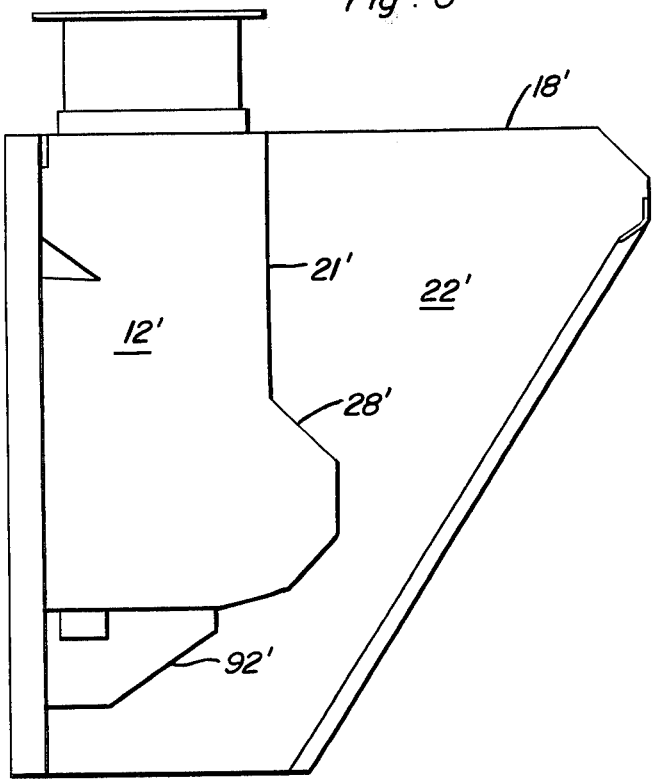
FIG. 6 is a side elevational view of another arrangement of the grease extractor apparatus with a modified hood collector.

FIG. 6 shows a modified grease extractor apparatus having similar structure to that described in FIGS. 1 and 2 and appropriately labeled with reference numerals having primes thereafter. A different type hood arrangement 18' and 22' is shown in this modification. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A ventilating system for drawing air from above cooking ranges and the like, comprising; a vertically oriented, upstanding housing adapted for mounting above a cooking range, a hood member secured to the housing for collecting contaminated air for passage through the housing, an entry chamber having an opening at an angle to the vertical arranged on the housing and adjacent the hood member, a plurality of baffle plates within the housing and arranged transversely of the air flowing through said housing, nozzle means within the chamber for imparting a spray of cold water across substantially the width of the chamber to extract contaminant materials entrained in the air, additional nozzle means disposed within the entry chamber for imparting a spray of hot wash liquid to said chamber and the baffle plates arranged therein, sump means at the bottom of said chamber for collecting and removing excess liquid and contaminant materials collected at the bottom of the chamber, an expansion chamber within the housing arranged above the forementioned structure to receive the flow of air and to permit an expansion and slowing of movement thereof, an exhaust duct communicating with the expansion chamber for exhausting the air after cleaning thereof, an easily removable central manifold structure, and said nozzle means and additional nozzle means are provided upon said central manifold structure for complete assembly and removal of the entire arrangement as an integral unit.

2. The structure as set forth in claim 1, wherein the aforementioned baffle plates are also mounted upon the integral manifold structure for removal as an entire unit from the overall apparatus.

3. The structure as set forth in claim 2, together with fire damper means provided adjacent the exhaust duct outlet for automatically closing off said exhaust duct in the case of fire within the overall apparatus.

4. The structure as set forth in claim 3, together with a removable front panel and baffle to cover and enclose the interior structure of the overall apparatus, and yet permit ready access thereto for maintenance, cleaning and repair.

5. The structure as set forth in claim 4, together with a replaceable baffle structure for varying the rate of airflow through the overall apparatus as desired for appropriate installations.

6. The structure as set forth in claim 5, wherein an interior baffle is provided for separating the contaminant sump into two portions with the first portion being adjacent the flow of exhaust air throughout the apparatus for creating a blowing effect upon the said surface to cause contaminant particles floating thereon to be pushed backwardly into the second part for exhaust out a sump overflow.

7. The structure as set forth in claim 6, wherein the angle of the opening to the entry chamber is approximately 45 degrees to the vertical.

8. The structure as set forth in claim 2, wherein the additional nozzle means includes at least two sets of spray nozzles for imparting hot wash liquid interiorly of the structure.

9. The structure as set forth in claim 8, wherein the additional nozzle means includes a further additional set of spray nozzles for imparting hot wash liquid into the interior of the apparatus.

10. A ventilating system for drawing air from above cooking ranges and the like, comprising; a vertically oriented, upstanding housing adapted for mounting above a cooking range, a hood member secured to the housing for collecting contaminated air for passage through the housing, an entry chamber having an opening at an angle to the vertical arranged on the housing and adjacent the hood member, a plurality of baffle means within the housing and arranged transversely of the air flowing through said housing, nozzle means within the chamber for imparting a spray of water across substantially the width of the chamber to extract contaminant materials entrained in the air, and sump means at the bottom of said chamber for collecting and removing excess liquid and contaminant materials collected at the bottom of the chamber, and an expansion chamber within the housing and above the forementioned structure to receive the flow of air therewithin and to permit an expansion and slowing of movement thereof, and an exhaust duct communicating with the expansion chamber for exhausting the air after cleaning thereof, an additional nozzle means disposed within the entry chamber for imparting a spray of wash liquid to said chamber and the baffle means arranged therein, and an interior baffle being provided for separating the contaminant sump means into two portions with the first portion being adjacent the flow of exhaust air throughout the apparatus for creating a blowing effect upon the water surface in the sump means to cause contaminant particles floating thereon to be pushed backwardly into the second portion for exhaust out a sump overflow, the lower edge of said interior baffle almost touching the water surface in the sump means so that the second portion is not in the flow of air through the first portion.

11. The structure as set forth in claim 10, wherein said baffle means includes a replacement baffle structure for varying the rate of airflow through the overall apparatus as desired and appropriate for different installations.

12. The structure as set forth in claim 11, together with a removable front panel and baffle to cover and enclose the interior structure of the overall apparatus, and yet permit ready access thereto for maintenance, cleaning and repair.

13. The structure as set forth in claim 12, together with fire damper means provided adjacent the exhaust duct outlet for automatically closing off said exhaust duct in the case of fire within the overall apparatus.

* * * * *